US006397490B1

(12) United States Patent
Inoki et al.

(10) Patent No.: US 6,397,490 B1
(45) Date of Patent: Jun. 4, 2002

(54) FLASH DRYING APPARATUS

(75) Inventors: Masahiro Inoki, Kyoto; Munehiro Kadowaki, Hirakata, both of (JP)

(73) Assignee: Hosokawa Micron Corporation, Osaka (JP)

( * ) Notice: Subject to any disclaimer, the term of this patent is extended or adjusted under 35 U.S.C. 154(b) by 0 days.

(21) Appl. No.: 09/627,150

(22) Filed: Jul. 27, 2000

(30) Foreign Application Priority Data

Jul. 29, 1999 (JP) ..... 11-215309

(51) Int. Cl.[7] ..... F26B 17/12
(52) U.S. Cl. ..... 34/168
(58) Field of Search ..... 34/168, 165; 106/740; 209/11; 241/52, 17; 426/467

(56) References Cited

U.S. PATENT DOCUMENTS

| | | | | |
|---|---|---|---|---|
| 1,550,992 A | | 8/1925 | Trump | 34/372 |
| 2,075,506 A | | 3/1937 | Crites et al. | 241/57 |
| 2,313,956 A | | 3/1943 | McGrane | 241/52 |
| 3,013,734 A | | 12/1961 | Hischmann | 241/17 |
| 3,289,950 A | * | 12/1966 | Helming et al. | 241/18 |
| 3,596,368 A | | 8/1971 | Zacpal et al. | 34/593 |
| 3,645,397 A | * | 2/1972 | Weiss | 209/464 |
| 4,114,289 A | * | 9/1978 | Boulet | 34/173 |
| 4,379,368 A | | 4/1983 | Keller | 34/586 |
| 4,617,744 A | * | 10/1986 | Siddoway et al. | 34/168 |
| 4,702,927 A | | 10/1987 | Hirotsuka et al. | 426/467 |
| 4,752,038 A | * | 6/1988 | Takahashi et al. | 241/158 |
| 4,756,428 A | * | 7/1988 | Jaeger | 209/135 |
| 4,964,845 A | * | 10/1990 | Mozley | 494/52 |
| 5,037,373 A | * | 8/1991 | Mozley | 494/55 |
| 5,383,609 A | * | 1/1995 | Prater | 241/29 |
| 5,387,267 A | * | 2/1995 | Warf et al. | 44/589 |
| 5,427,738 A | * | 6/1995 | Galloway | 422/26 |
| 5,772,130 A | * | 6/1998 | Toschi | 241/30 |

FOREIGN PATENT DOCUMENTS

| | | |
|---|---|---|
| DE | 1931 272 | 12/1970 |
| EP | 0 410 043 A1 | 1/1991 |
| LU | 81 449 | 7/1979 |
| WO | WO 97/19307 | 5/1997 |
| WO | WO 99/27316 | 6/1999 |

* cited by examiner

*Primary Examiner*—Teresa Walberg
*Assistant Examiner*—Daniel Robinson
(74) *Attorney, Agent, or Firm*—Arent Fox Kintner Plotkin & Kahn, PLLC

(57) ABSTRACT

A flash drying apparatus has a vertical, cylindrical enclosure. In a lower portion of this enclosure is disposed a rotating disk. Above this disk is provided a crusher that, using blades formed radially thereon, crushes a raw material into a powdery or granular material. The crusher is provided with a material feeder that feeds the raw material to the crusher by letting the raw material fall onto the crusher. A hot wind feeder feeds a hot wind to the powdery or granular material from under the blades. The powdery or granular material blown upward inside the enclosure by the hot wind is exhausted through an exhaust duct provided in an upper portion of the enclosure. This flash drying apparatus prevents degradation in performance resulting from deposition of a raw material.

13 Claims, 17 Drawing Sheets

FLASH DRYING APPARATUS

BACKGROUND OF THE INVENTION

1. Field of the Invention

The present invention relates to a flash drying apparatus for crushing and drying a raw material containing moisture.

2. Description of the Prior Art

A conventional flash drying apparatus is constructed as shown in FIG. 1. The flash drying apparatus has an enclosure 5 composed of a plurality of cylindrical or truncated conical members coupled together. In a lower portion of the enclosure 5 is provided an inlet 1 through which a hot wind supplied from a hot wind source (not shown) is fed into the enclosure 5. Above the inlet 1 is provided a crushing rotor 12 that is driven to rotate by a driving motor 10 through a belt 14.

The crushing rotor 12 has a plurality of stirrup-shaped hammers 4 that face the inner wall of the enclosure 5, constituting a crusher 3 in which a raw material is crushed as the hammers rotate. Above the crusher 3 is provided a material feeder 9 through which the raw material is fed in. The material feeder 9 is provided with a screw feeder (not shown) so that the raw material stored in a hopper (not shown) or the like is fed out through an outlet 9*b* so as to fall into the crusher 3.

In an upper portion of the enclosure 5 is provided a classifier 6 that classifies a powdery or granular material. The classifier 6 has a plurality of classifying blades 13 that are made of thin plates, arranged radially, and driven to rotate by a driving motor 8. As shown in FIG. 2, the classifying blades 13 are each arranged with a predetermined inclination a relative to a center line 6*a*.

This arrangement serves to keep the rotation speed of the classifying blades 13 at an appropriate rate and simultaneously limit entry of the powdery or granular material into the classifier 6. Above the classifier 6 is provided an exhaust duct 7 that is sucked by a blower (not shown) to permit the powdery or granular material to be exhausted together with air and water vapor.

In this flash drying apparatus constructed as described above, a raw material containing moisture is supplied from the material feeder 9 in such a way as to fall onto the crushing rotor 12 that is driven to rotate by the driving motor 10. The raw material, originally in the form of clusters, collides with the hammers 4, and is thereby crushed into a powdery or granular material. This powdery or granular material is blown upward from under the hammers 4 by a hot wind introduced through the inlet 1 into the enclosure 5, and is thereby, while flowing upward inside the enclosure 5, further dispersed and dried.

On the other hand, the classifying blades 13 that are driven to rotate by the driving motor 8 produces a vortex air stream. The powdery or granular material having flown upward inside the enclosure 5 and come close to the classifier 6 is acted upon simultaneously by the centrifugal force of this vortex air stream and by the centripetal force of the air and water vapor being exhausted. The insufficiently dispersed portion of the powdery or granular material is acted upon more by the centrifugal force, and is therefore thrown out of the classifier so as to fall onto the crusher 3 and be exposed to the hot wind once again.

The powdery or granular material thus dispersed and dried once again is acted upon more by the centripetal force, and is therefore permitted to enter the classifier 6 through the gaps 6*b* between the classifying blades 13. The powdery or granular material is then exhausted through the exhaust opening 7*a* of the exhaust duct 7 in the form of dry powder or granules of uniform particle size.

When the raw material is slurry or liquid, i.e. a mixture of a powdery or granular material with a large amount of water, the material is usually formed into cakes using a filter press before being supplied. In less usual cases where such a raw material is supplied as it is, i.e. in the form of slurry or liquid, it is fed in through a pipe provided in the material feeder 9 in such a way as to flow down onto the crushing rotor 12. Then, the raw material, acted upon by centrifugal force, moves outward and makes contact with the hammers 4. Thus, the raw material is dispersed and formed into liquid droplets, and is then dried by the hot wind.

However, in this conventional flash drying apparatus, the raw material, containing moisture, tends to be deposited on the inner wall of the enclosure 5. In particular, the portion of the raw material that falls along the inner wall of the enclosure 5 makes contact with the top surfaces of the stirrup-shaped hammers 4 at the same portion thereof. As a result, this portion of the raw material is not dispersed uniformly, but is scattered, before being subjected to heat exchange with the hot wind, in such a way as to be deposited on the inner wall of the enclosure 5 at about the same portion thereof above the hammers 4.

As this deposit grows, there is a risk of an unduly great pressure loss, or clogging of the passage inside the enclosure 5, which makes the flash drying apparatus unusable. On the other hand, simply increasing the amount of supplied hot wind causes the powdery or granular material having entered the classifier 6 to collide with the classifying blades 13 and be thereby deposited thereon. This, similarly, may lead to clogging of the gaps 6*b* between the classifying blades 13, causing an unduly great pressure loss.

In cases where the raw material is slurry or liquid containing a large amount of water and is fed in through a pipe so as to flow onto the crushing rotor 12, the raw material, acted upon by centrifugal force, flows outward along strip-shaped paths on the top surface of the crushing rotor 12. Thus, the raw material makes contact with the hammers without being sufficiently dispersed. This causes the raw material to be dispersed in the form of comparatively large drops and thus deposited on the inner wall of the enclosure 5 without being dried. As this deposit grows, clogging of the passage inside the enclosure 5 may result.

SUMMARY OF THE INVENTION

An object of the present invention is to provide a flash drying apparatus that can prevent degradation in performance resulting from deposition of a raw material.

Another object of the present invention is to provide a flash drying apparatus that can satisfactorily dry even a raw material in the form of slurry or liquid containing a large amount of water.

To achieve the above objects, according to the present invention, a flash drying apparatus for drying a material containing moisture is provided with: a vertical, cylindrical enclosure; a crusher, composed of a rotating plate-shaped member and a crushing member provided integrally therewith, and disposed in a lower portion of the enclosure, for crushing the raw material into a powdery or granular material; a material feeder for feeding the raw material to the crusher by letting the raw material fall onto the crusher; a hot wind feeder for feeding a hot wind to the powdery or granular material from under the crushing member; a classifier for classifying the powdery or granular material blown upward inside the enclosure by the hot wind; and an exhauster for exhausting the classified powdery or granular material through an upper portion of the enclosure. Here, the crushing member is composed of a plurality of blades made of thin plates, arranged radially above the plate-shaped member, and supported by being coupled to a ring-shaped member provided substantially parallel to the plate-shaped member.

As described above, according to the present invention, the blades are made of thin plates, and are supported by being coupled to the ring-shaped member. This helps reduce the amount of raw material that falls onto the blades and then remains deposited thereon, and thereby restrain the growth of the deposit on the inner wall of the enclosure. Moreover, an air stream passage is formed that permits the air above the crusher to flow from the inside to the outside through the gaps between the blades. This permits the powdery or granular material to be dried repeatedly and thus more fully.

Moreover, the ring-shaped member prevents the blades from being inclined by centrifugal force, and thus permits the blades to be made higher. This helps increase the length of time for which the raw material is crushed while being exposed to the hot wind. Thus, it is possible to disperse the powdery or granular material more fully than ever immediately after the crushing thereof, and thereby further restrain the deposition of the powdery or granular material on the inner wall of the enclosure in a portion thereof above the blades.

BRIEF DESCRIPTION OF THE DRAWINGS

This and other objects and features of the present invention will become clear from the following description, taken in conjunction with the preferred embodiments with reference to the accompanying drawings in which.

DESCRIPTION OF THE PREFERRED EMBODIMENTS

Figure 1:
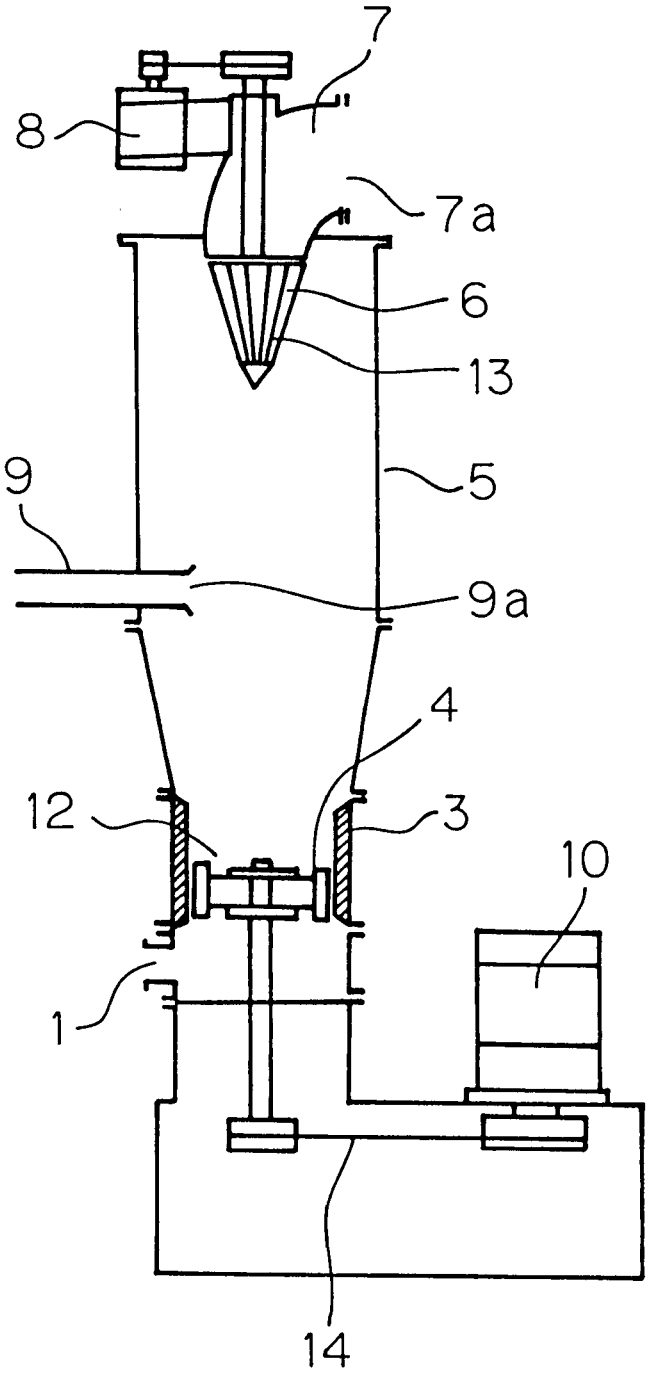
FIG.1 PRIOR ART
FIG. 1 is a sectional view of a conventional flash drying apparatus.
Figure 3:
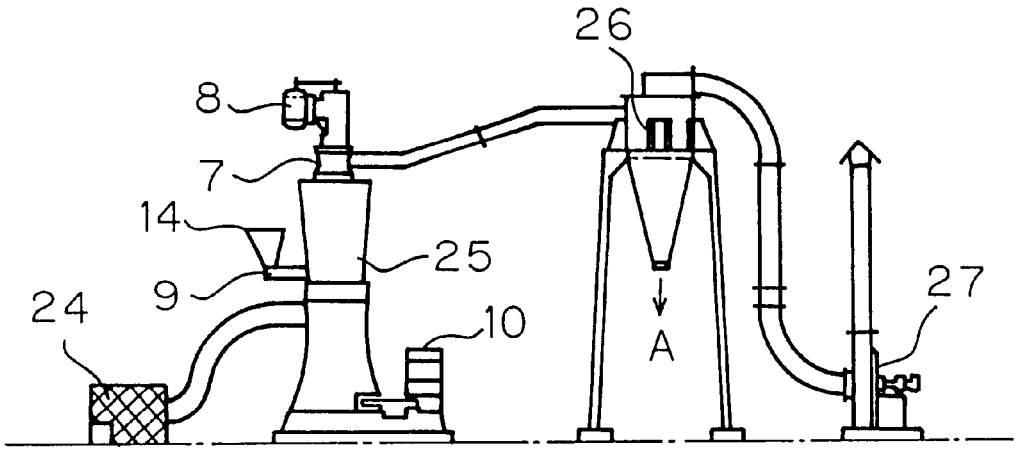
FIG. 3 is a diagram showing the configuration of a dryer system employing the flash drying apparatus of a first embodiment of the invention.

Hereinafter, embodiments of the present invention will be described with reference to the drawings. For convenience' sake, elements corresponding to those found in the conventional example shown in FIG. 1 are identified with the same reference numerals. FIG. 3 is a diagram schematically showing the configuration of a dryer system employing the flash drying apparatus of a first embodiment of the invention. The flash drying apparatus 25 is, in a substantially central portion thereof, provided with a material feeder 9 that has a hopper 14 and that supplies the flash drying apparatus 25 with a raw material.

Connected to the flash drying apparatus 25, below the material feeder 9, is a hot wind generating apparatus 24 that supplies the flash drying apparatus 25 with a hot wind. In an upper portion of the flash drying apparatus 25 is provided an exhaust duct, through which the powdery or granular material crushed and dried inside the flash drying apparatus 25 is exhausted from the flash drying apparatus 25 together with water vapor.

The exhaust duct 7 is connected to a collector 26, which in turn is connected to a blower 27. Thus, the powdery or granular material is sucked toward the collector 26 by the blower 27 so as to be collected as indicated by arrow A, and the water vapor is exhausted through the blower 27 to the outside.

Figure 4:
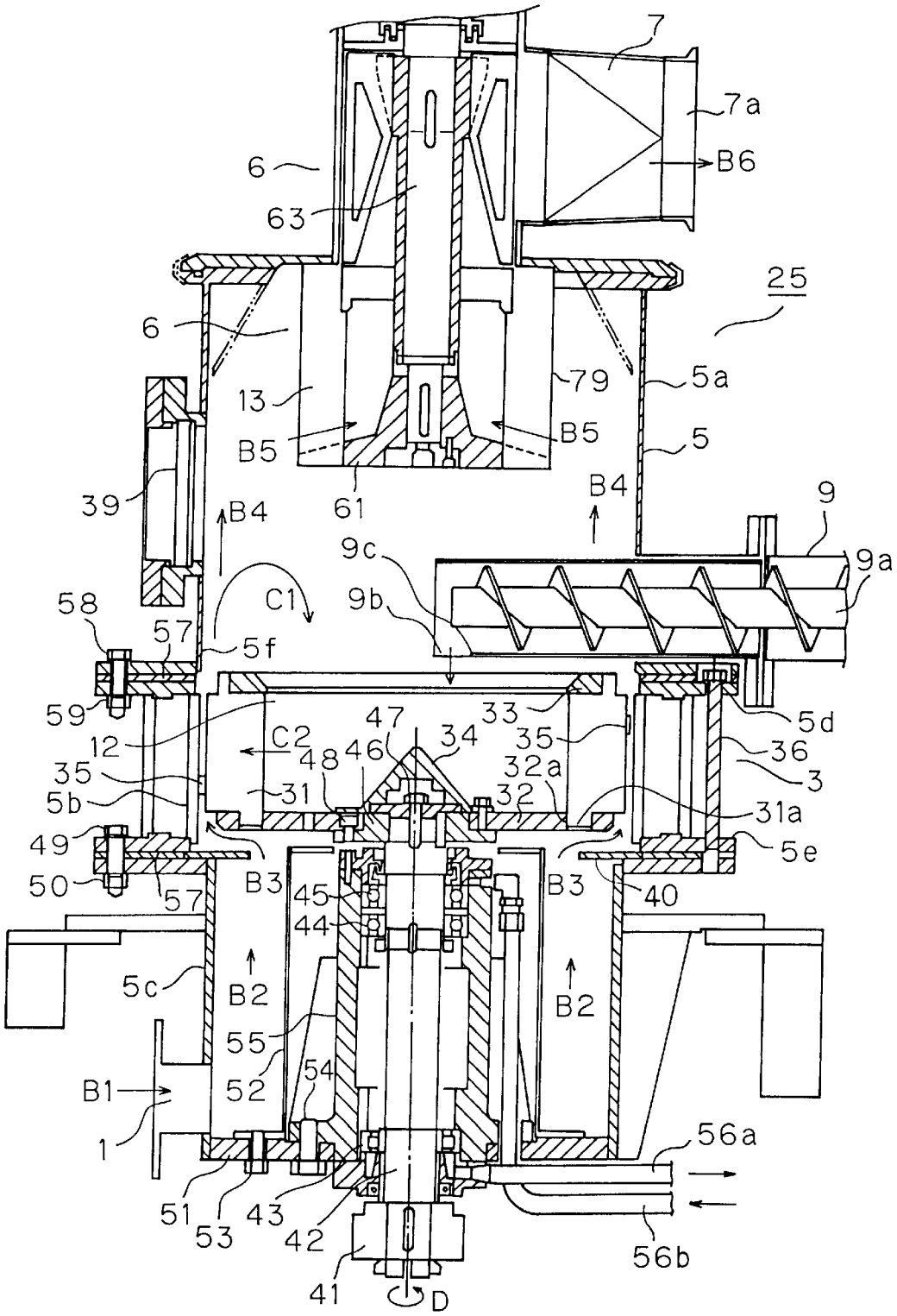
FIG. 4 is a sectional view of the flash drying apparatus of the first embodiment of the invention.

FIG. 4 shows a sectional view of the flash drying apparatus 25. The flash drying apparatus 25 is enclosed in an enclosure 5 composed of an upper casing 5*a*, a liner 5*b*, and a lower casing 5*c*, all cylindrical in shape. The upper and lower casings 5*a* and 5*c* are formed out of sheet steel or the like. The liner 5*b* is formed out of such a material and in such a shape as to have higher strength than the upper and lower casings 5*a* and 5*c*. This helps prevent breakage or wear of the liner 5*b* resulting from collision of the raw material therewith occurring as a crushing rotor 12, described later, rotates.

The liner 5*b* has brims 5*d* and 5*e* fitted integrally thereto with a plurality of bolts 36. The upper casing 5*a* is fastened to the brim 5*d* with a plurality of bolts 58 and nuts 59 and with a gasket 57 placed in between. The lower casing 5*c* is fastened to the brim 5*e* with a plurality of bolts 49 and nuts 50 and with a gasket 57 placed in between. The gaskets 57 serve to keep the inside of the enclosure 5 airtight. In addition, between the lower casing 5*c* and the brim 5*e*, a deflector ring 40 is provided.

The lower casing 5*c* has an inlet 1 formed therein, through which a hot wind supplied from the hot wind generating apparatus 24 (see FIG. 3) is introduced into the enclosure 5. The lower casing 5*c* has a bottom plate 51 welded at the bottom end thereof. On the bottom plate 51, a housing 55 for housing bearings 43, 44, and 45 is fitted with bolts 54. Moreover, on the bottom plate 51, a dust cover 52 for preventing entry of the powdery or granular material into the housing 55 is fitted with bolts 53.

Fitted into the bearings 43, 44, and 45 is a shaft 42. The shaft 42 has a pulley 41 fitted thereto at the bottom end thereof, which is coupled to the driving motor 10 (see FIG. 3) through a belt (not shown). The bearings 43, 44, and 45 are lubricated with lubricating oil that is supplied at their top and drained at their bottom through oil tubes 56*a* and 56*b* connected to an oil feeding apparatus (not shown) that circulates the lubricating oil.

Figure 5:
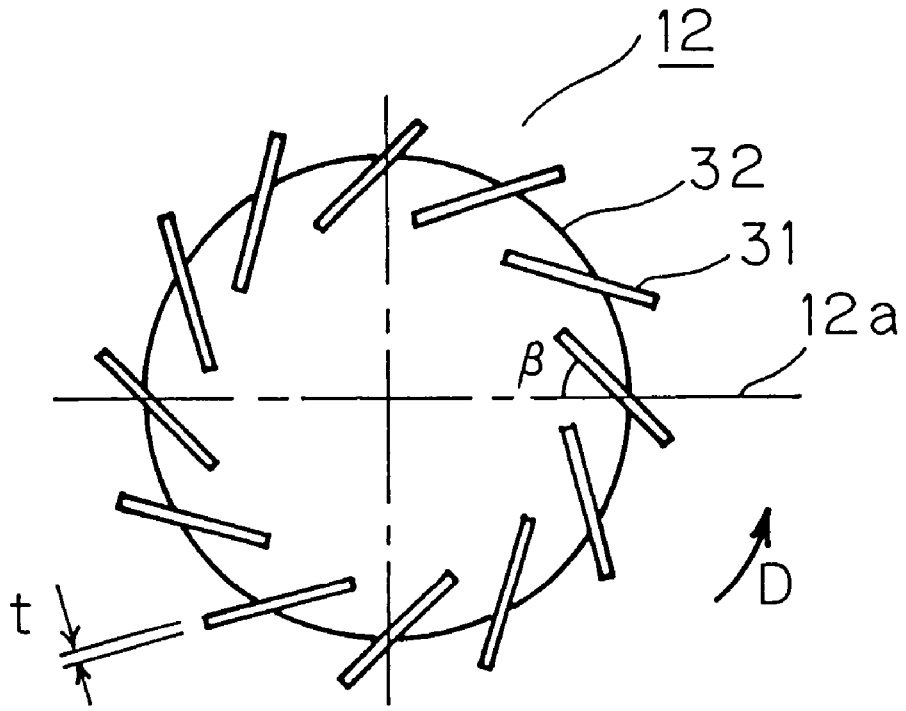
FIG. 5 is a plan view of the crushing rotor of the flash drying apparatus of the first embodiment of the invention.

The shaft 42 has a flange 46 fitted thereto at the top end thereof with a bolt 47. The flange 46 has a disk (plate-shaped member) 32 fitted thereon with bolts 48. As shown in FIG. 5, the disk 32 has a plurality of blades 31, made of thin plates with a thickness t, arranged radially so as to protrude outward from the outer circumference of the disk 32 and face the liner 5*b*.

The blades 31 have projections 31*a* formed at the bottom ends thereof, and these projections 31*a* are press-fitted into slits 32*a* formed in the disk 32. The blades 31 have their top ends welded to a ring-shaped member 33. Thus, the disk 32, blades 31, and ring-shaped member 33 together constitute a crushing rotor 12 that rotates integrally with the shaft 42. The blades 31 may be held by fastening together the disk 32 and the ring-shaped member 33 with bolts with the blades 31 sandwiched between them.

In FIG. 5, the blades 31 are each arranged with an inclination β relative to a center line 12*a* of the crushing rotor 12. Thus, as the crushing rotor 12 rotates in the direction indicated by arrow D, it produces an air stream that flows from the inside to the outside of the blades 31.

Above the crushing rotor 12, a material feeder 9 is provided so as to protrude into the enclosure 5. The material feeder 9 has a screw feeder 9*a* provided inside it. As this screw feeder 9*a* rotates, a raw material, in the form of clusters, is fed out through an outlet 9*b* in such a way as to fall onto the crushing rotor 12.

The raw material thus fed to the crushing rotor 12 is, by the centrifugal force resulting from the rotation of the crushing rotor 12, transferred to the outer circumference thereof so as to be crushed into a powdery or granular material by the blades 31. Thus, this portion as a whole constitutes a crusher 3. Here, to prevent the raw material from reaching the shaft 42, and to ease the transfer of the raw material to the outer circumference of the crushing rotor 12, a conical cover 34 is provided on the disk 32.

Figure 6:
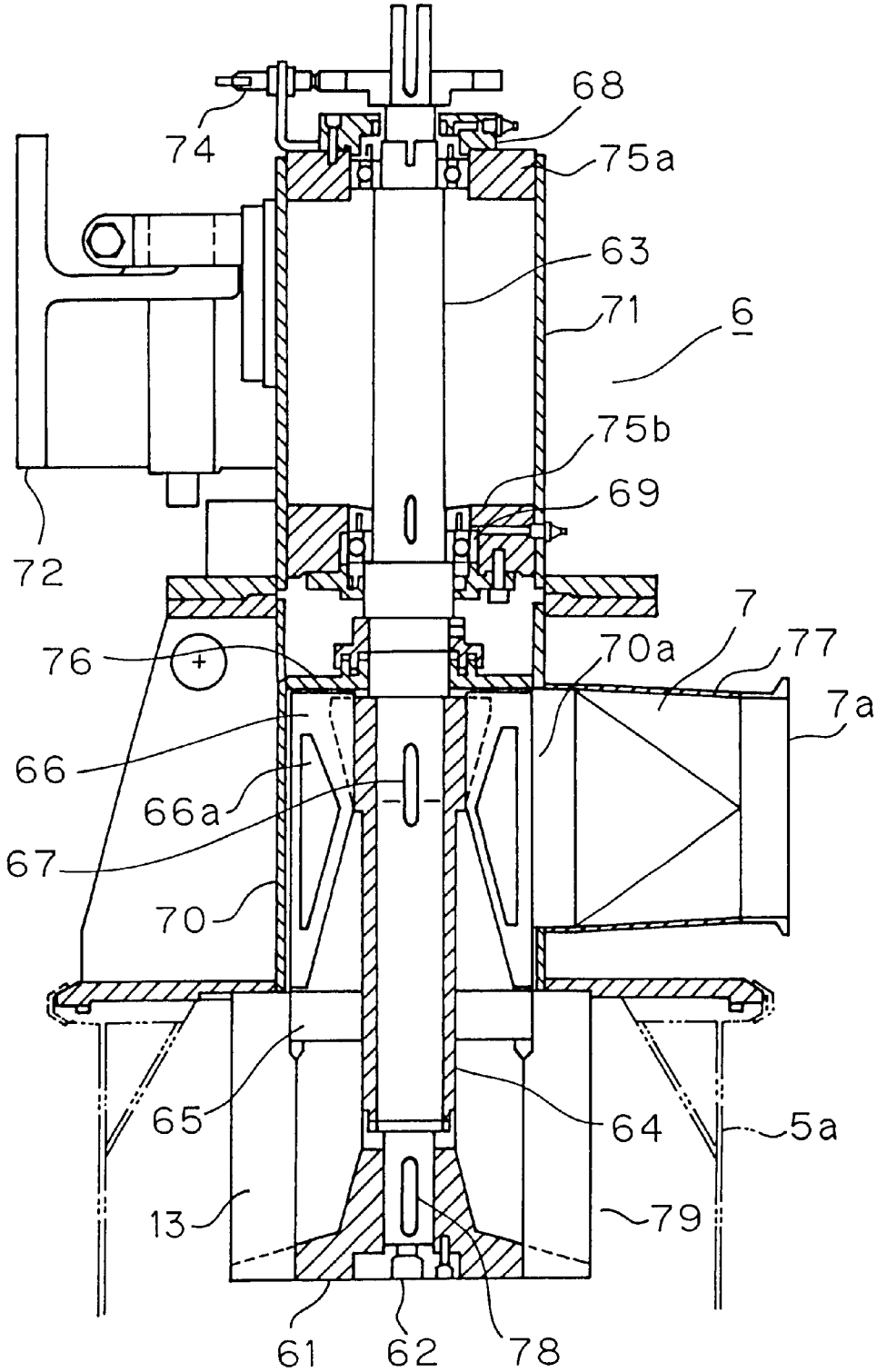
FIG. 6 is a sectional view of the classifier of the flash drying apparatus of the first embodiment of the invention.

At the side of the upper casing 5*a*, a sight glass 39 made of glass is provided that permits inspection of the inside of the enclosure 5. At the top of the upper casing 5*a*, a classifier 6 is fitted thereto. As shown in FIG. 6, the classifier 6 is enclosed in an upper cover 71 and a lower cover 70 that are fastened together with a plurality of bolts and nuts (not shown).

Inside the upper cover 71, housings 75*a* and 75*b* for housing bearings 68 and 69 are welded thereto. Fitted into the bearings 68 and 69 is a shaft 63. At the side of the upper cover 71, an angle 72 is provided, on which the driving motor 8 (FIG. 3) is mounted. The shaft 63 is coupled to the driving motor 8 through a belt (not sown) so as to be driven to rotate. In addition, above the upper cover 71 is provided a photoelectric switch 74 for detecting the rotation rate of the shaft 63.

The lower cover 70 has an opening at the bottom end thereof so as to communicate with the inside of the casing 5*a*. The lower cover 70 is, in an upper portion thereof, sealed by a sealing member 76. The lower cover 70 has an opening 70*a* formed in the circumferential surface thereof, and has a cylindrical pipe 77 welded thereto so as to cover the opening 70*a*.

Thus, the lower cover 70 and the cylindrical pipe 77 together constitute an exhaust duct 7. As compared with the duct 7 used in the conventional example (see FIG. 1) that is formed out of a curved cylindrical pipe, this duct 7 helps increase the cross-sectional area of the exhaust passage around the shaft 63, and thereby prevent clogging caused by the powdery or granular material deposited on the inner wall of the exhaust duct 7.

Around the portion of the shaft 63 that penetrates the lower cover 70 is fitted an outer cylinder 64 that rotates together with the shaft 63 by being interlocked therewith by a key 67. The outer cylinder 64 has a scraper 66 formed integrally therewith. The scraper 66 is made of a thin plate and serves to scrape off the powdery or granular material deposited on the inner wall of the lower cover 70. To reduce the pressure loss inside the exhaust duct 7, the scraper 66 has portions 66*a* thereof cut out.

Figure 7:
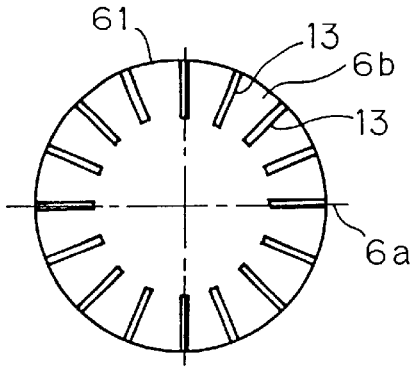
FIG. 7 is a plan view of the classifying rotor of the flash drying apparatus of the first embodiment of the invention.

The shaft 63 has, at the bottom end thereof that protrudes into the upper casing 5*a*, a disk 61 fitted thereto with a bolt 62 so as to be rotatable together with the shaft 63 by being interlocked therewith by a key 78. As shown in FIG. 7, the disk 61 has a plurality of classifying blades 13, made of thin plates, arranged radially.

The classifying blades 13 have their upper ends welded to a ring-shaped member 65. Thus, the disk 61, classifying blades 13, and ring-shaped member 65 together constitute a classifying rotor 79 that rotates integrally with the shaft 63.

In this flash drying apparatus 25 constructed as described above, as the screw feeder 9*a* rotates, a raw material containing moisture, in the form of clusters, is made to fall onto the crushing rotor 12 that is rotated in the direction D by being driven by the driving motor 10. The rotation of the crushing rotor 12 produces centrifugal force, by which the raw material is transferred to the outer circumference of the crushing rotor 12. Then, the raw material collides with the blades 31 and is thereby crushed into a powdery or granular material.

The hot wind generating apparatus 24 (see FIG. 3) is driven so that a hot wind is introduced into the flash drying apparatus 25 through the inlet 1 as indicated by arrow B1.

The hot wind then flows upward outside the dust cover 55 L1 as indicated by arrows B2, and then passes through the gap between the disk 32 and the liner 5*b* as indicated by arrows B3. Here, the powdery or granular material crushed by the blades 31 is blown upward by the hot wind while being further dispersed, and thus the powdery or granular material, together with the hot wind, flows upward inside the enclosure 5 as indicated by arrows B4.

The classifying blades 13, by being driven to rotate by the driving motor 8, produces a vortex air stream. The powdery or granular material having flown upward inside the enclosure 5 and come close to the classifier 6 is subjected to classification by being acted upon simultaneously by the centrifugal force of this vortex air stream and by the centripetal force of the air and water vapor being exhausted. The insufficiently dried powdery or granular material is acted upon more by the centrifugal force, and is therefore thrown out of the classifier 6 so as to be circulated back to the crusher 3 located below.

The sufficiently dried and dispersed powdery or granular material is acted upon more by the centripetal force, and is therefore permitted to enter the classifier 6 through the gaps 6*b* between the classifying blades 13 as indicated by arrows B5. Then, the powdery or granular material is exhausted through the exhaust opening 7*a* of the exhaust duct 7 as indicated by arrow B6 in the form of dry powder or granules of uniform particle size.

In this embodiment, the material feeder 9 protrudes into the enclosure 5, so that the raw material is fed substantially to the center of the disk 32. This helps restrain the deposition of the powdery or granular material on the inner wall 5*f* of the enclosure 5 above the blades 31. It is preferable that the protrusion of the material feeder 9 be such that the end surface 9*c* of the outlet 9*b* thereof, as seen on a plan view, is located on the inside of the blades 31. However, in cases where the material feeder 9 and the crushing rotor 12 are disposed away from each other, if the material feeder 9, as seen in a plan view, protrudes at least into the outer circumferential surface of the blades 31, it is possible to restrain the deposition of the raw material resulting from the raw material in the form of clusters falling along the inner wall of the enclosure 5 below the material feeder 9.

Figure 8:
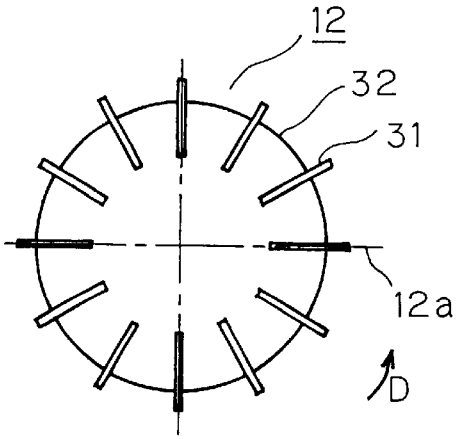
FIG. 8 is a plan view of another design of the crushing rotor of the flash drying apparatus of the first embodiment of the invention.

Using stirrup-shaped hammers 4 (see FIG. 1) as in the conventional example permits the raw material to be deposited on the hammers 4, which prompts the growth of the deposit on the inner wall of the enclosure 5. However, in this embodiment, the blades 31 have a small thickness t (see FIG. 5), and thus the amount of raw material that falls onto the blades 31 and is deposited thereon is small. This helps restrain the growth of the deposit on the inner wall 5*f* of the enclosure 5. As shown in FIG. 8, it is also possible to reduce the amount of raw material deposited on the blades 31 by arranging the blades 31 so as to be aligned with center lines 12*a* of the crushing rotor 12.

Figure 9:
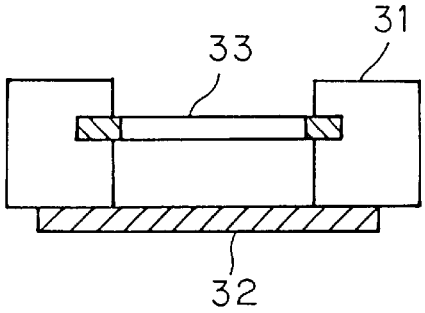
FIG. 9 is a plan view of another design of the ring-shaped member of the crushing rotor of the flash drying apparatus of the first embodiment of the invention.

Moreover, the upper ends of the blades 31, which are made of thin plates, are supported by being coupled to the ring-shaped member 33. This helps prevent the blades 31 from being inclined outward by the centrifugal force produced by the rotation of the crushing rotor 12. As shown in FIG. 9, it is also possible to support the blades 31 by coupling them, at central portions thereof, to the ring-shaped member 33.

This makes it possible to make the blades 31 higher, and thereby increase the length of time for which the raw material is dispersed and crushed while being exposed to the hot wind. As a result, it is possible to disperse the powdery or granular material more fully than ever immediately after it has passed through the crusher 3, and thus dry the powdery or granular material more fully. This helps further restrain the deposition of the powdery or granular material on the inner wall of the enclosure 5 above the blades 31.

Moreover, since the blades 31 are arranged with an inclination (see FIG. 5) and are coupled to the ring-shaped member 33, as the crushing rotor 12 rotates, an air stream passage is formed that leads from the inside to the outside of the blades 31 between the ring-shaped member 33 and the disk 32 as indicated by arrow C2. This produces suction force acting toward the inside of the blades 31 as indicated by arrow C1, and thereby permits the powdery or granular material to be dried repeatedly. Thus, the powdery or granular material reaches the classifier 6 after being dried fully.

Figure 10:
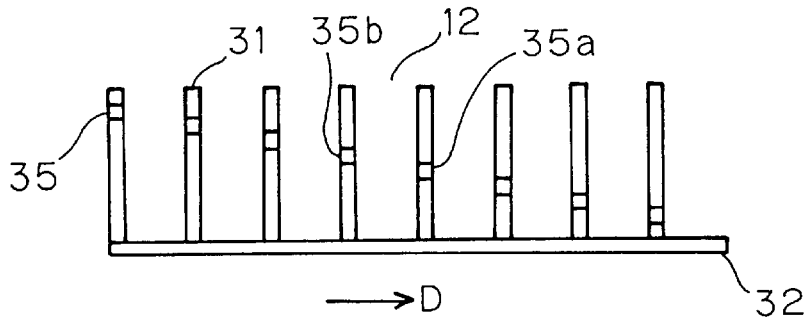
FIG. 10 is a developed view illustrating an example of the arrangement of the projections provided on the crushing rotor of the flash drying apparatus of the first embodiment of the invention.

On those surfaces of the blades 31 that face the liner 5*b*, projections 35 are provided, with a predetermined gap secured between each projection 35 and the liner 5*b*. These projections 35 scrape off the powdery or granular material deposited between the blades 31 and the liner 5*b*, and in addition produce a disturbed air stream that helps further disperse the powdery or granular material. As shown in FIG. 10, which is a schematic developed view of the crushing rotor 12, the projections 35 are provided at increasingly lower heights along the direction of rotation (indicated by D) of the crushing rotor 12.

This makes it possible to scrape off the powdery or granular material over the entire height of the liner 5*b*, and in addition disperse more fully the powdery or granular material thus scraped off. Specifically, for example, the powdery or granular material scraped off by the projection 35*a* is blown upward by the hot wind flowing from below, but then collides with the projection 35*b* that moves as the crushing rotor 12 rotates in the direction D. This limits the upward flow of the powdery or granular material, and thus the powdery or granular material, while being stagnated in this way, is dispersed more fully.

Figure 11:
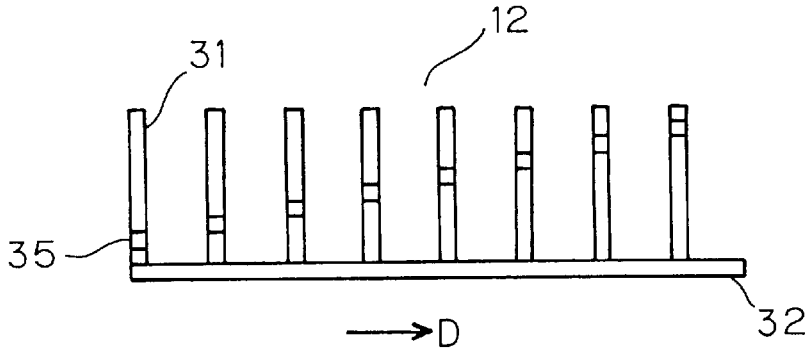
FIG. 11 is a developed view illustrating another example of the arrangement of the projections provided on the crushing rotor of the flash drying apparatus of the first embodiment of the invention.
Figure 12:
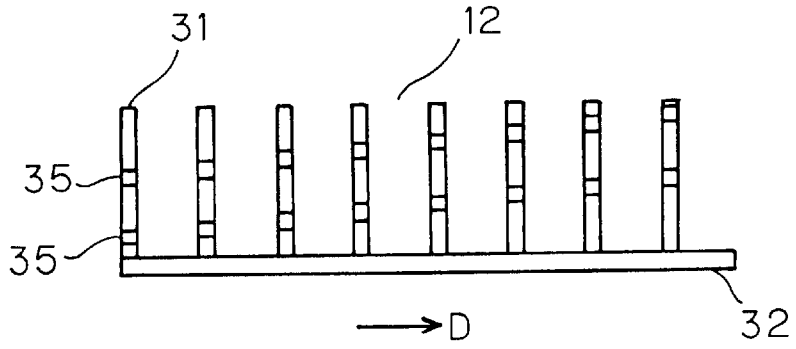
FIG. 12 is a developed view illustrating still another example of the arrangement of the projections provided on the crushing rotor of the flash drying apparatus of the first embodiment of the invention.

When the raw material being processed does not need to be stagnated, as shown in FIG. 11, the projections 35 may be provided at increasingly great heights along the direction of rotation (indicated by D) of the crushing rotor 12. Alternatively, as shown in FIG. 12, it is also possible to provide a plurality of projections 35 on each of the blades 31 so that the projections 35 are arranged at gradually varying heights so as to form a multiple helix, or to provide projections 35 on only part of the blades 31. It is preferable to design the projections 35 to be fitted in desired positions with bolts or the like, because this permits the projections 35 to be fitted in varying positions according to the type of the raw material actually processed.

Figure 13:
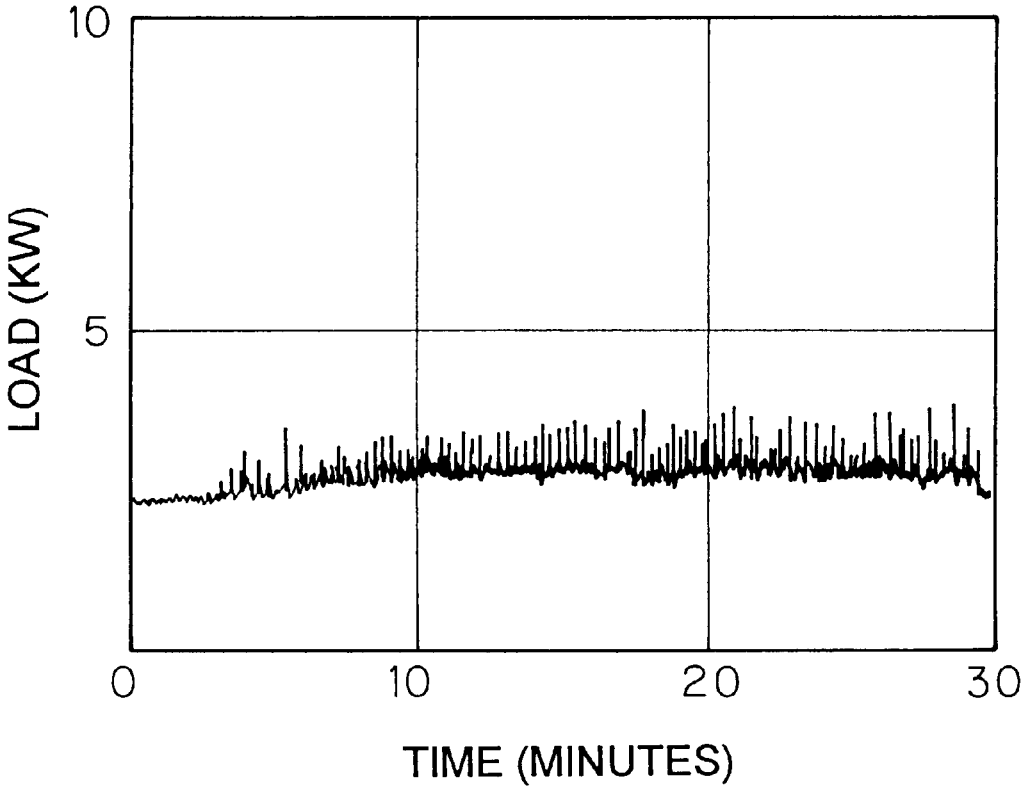
FIG. 13 is a diagram showing the load on the driving motor as observed when projections are provided on the crushing rotor of the flash drying apparatus of the first embodiment of the invention.
Figure 14:
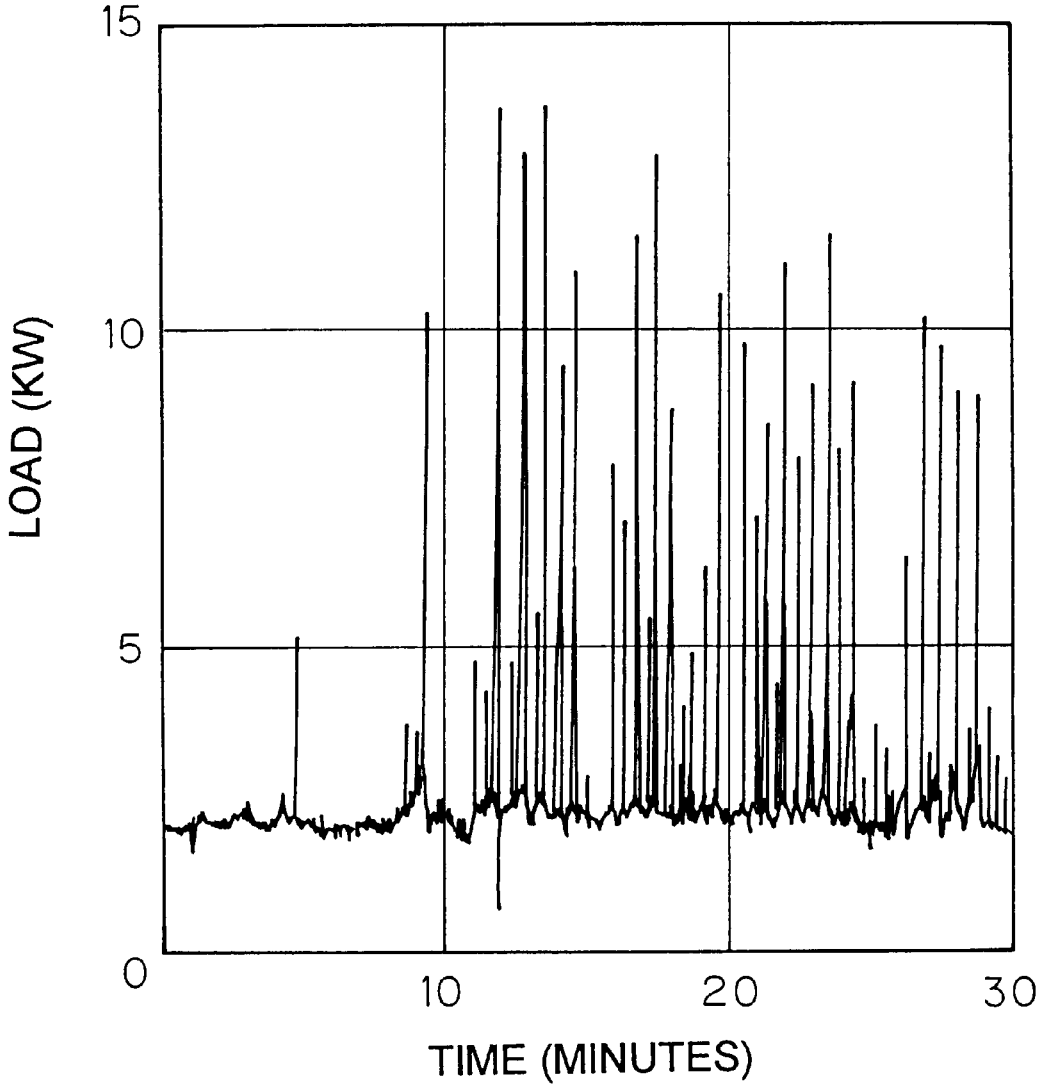
FIG. 14 is a diagram showing the load on the driving motor as observed when no projections are provided on the crushing rotor of the flash drying apparatus of the first embodiment of the invention.

FIG. 13 shows the load on the driving motor 10 as observed when the projections 35 are provided as shown in FIG. 10, and FIG. 14 shows the load on the driving motor 10 as observed when the projections 35 are removed. FIGS. 13 and 14 show the results obtained by using the same raw material, with a gap of 5 mm secured between the liner 5*b* and the blades 31, a gap of 1.5 mm secured between the liner 5*b* and the projections 35, the blades 31 and the projections 35 respectively being 100 mm and 15 mm high, and the crushing rotor 12 rotating at a rotation rate of 4,000 rpm.

These diagrams show that, without the projections 35, the powdery or granular material deposited on the liner 5*b* is scraped off by the blades 31 over the entire height thereof at a time, and thus the load on the driving motor 10 shows large fluctuations. By contrast, with the projections 35, scraping takes place sequentially in one range of heights after another, and thus the load on the driving motor 10 shows only small fluctuations.

Thus, providing the projections 35 makes it possible to use a driving motor 10 with a lower maximum output and thereby reduce the manufacturing cost of the flash drying apparatus. The size of the projections 35 and the gap between them and the liner 5*b* can best be determined in accordance with the type of the raw material actually processed and other factors, and thus are not limited to any specific dimensions given above.

As shown in FIG. 7 described earlier, the blades 13 of the classifier 6 are arranged so as to be aligned with center lines 6*a* of the classifier 6. This helps reduce the probability of the powdery or granular material colliding with the classifying blades 13 when entering the classifier 6. Moreover, even if the powdery or granular material is deposited on the classifying blades 13, the deposit readily comes off and does not grow.

In this way, it is possible to prevent clogging of the gaps 6*b* between the classifying blades 13. It is however to be noted that, in cases where the classifying rotor 79 is driven to rotate at such a rotation rate as is conventionally used, it is easier for the powdery or granular material to enter the classifier 6. To avoid this, in such cases, it is necessary to provide a greater number of classifying blades 13 than in the conventional example (see FIG. 2).

Figure 2:
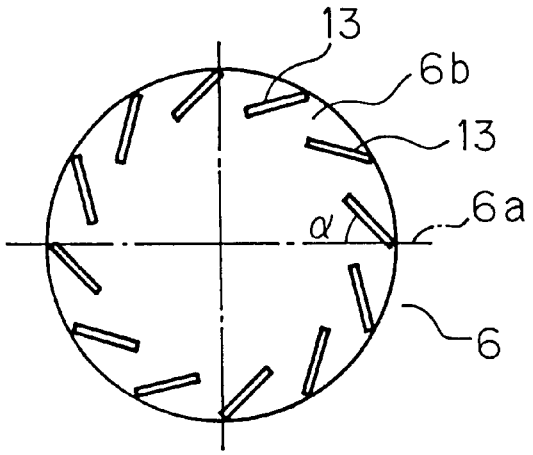
FIG.2 PRIOR ART
FIG. 2 is a plan view of the classifying blades of a conventional flash drying apparatus.
Figure 15:
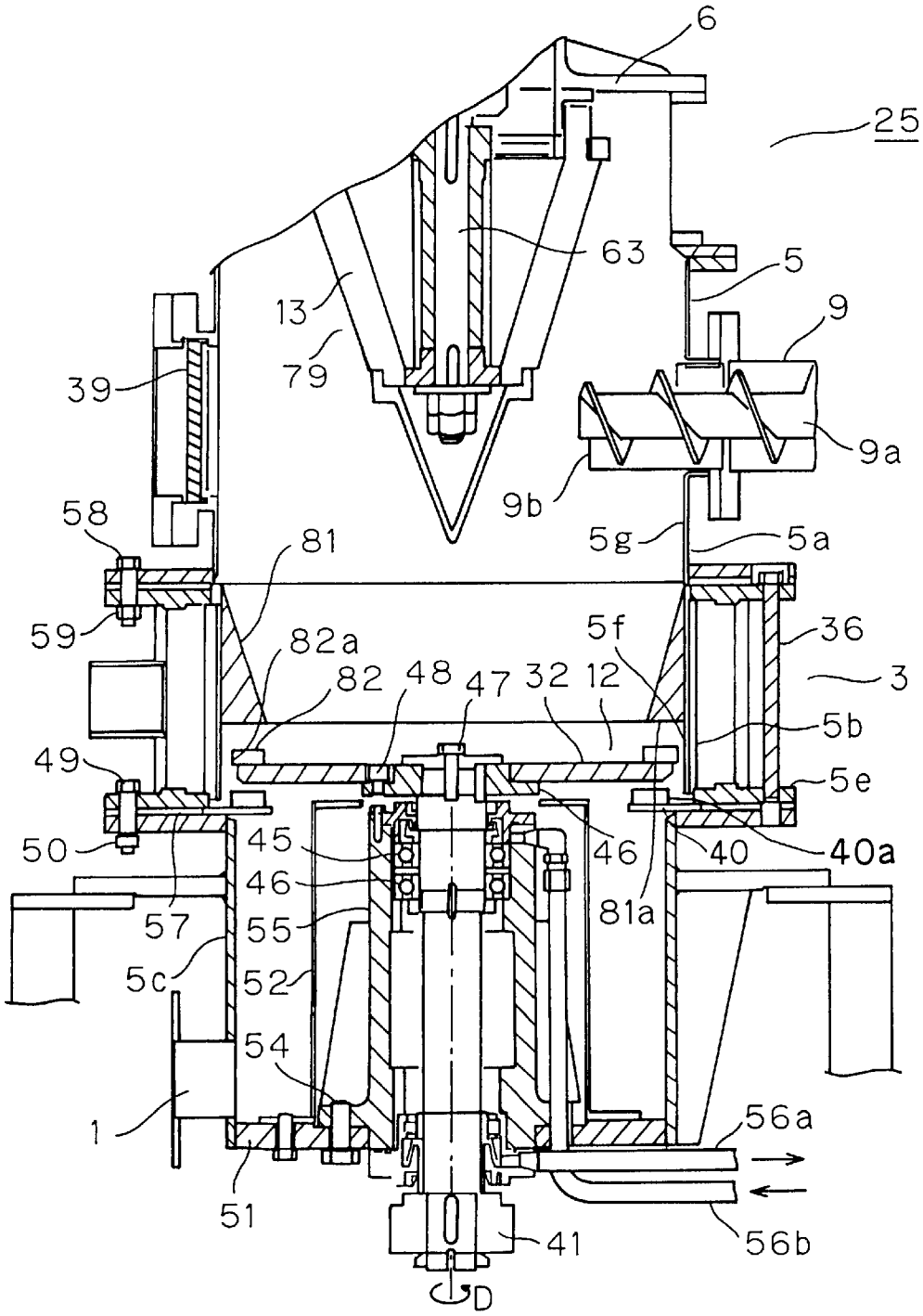
FIG. 15 is a sectional view of the flash drying apparatus of a second embodiment of the invention.

Next, FIG. 15 is a sectional view of the flash drying apparatus 25 of a second embodiment of the invention. Here, such elements as are found also in the first embodiment shown in FIG. 4 are identified with the same reference numerals. In this embodiment, the classifier 6 is constructed in the same manner as in the conventional example (see FIG. 1). Accordingly, as shown in FIG. 2 described earlier, the classifying blades 13 are each arranged with an inclination relative to a center line 6*a* of the classifier 6.

Figure 16:
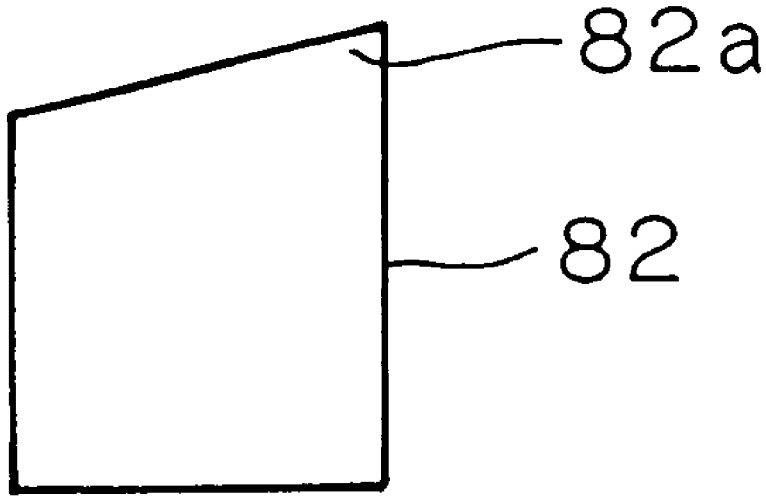
FIG. 16 is a plan view of the hammer of the flash drying apparatus of the second embodiment of the invention.
Figure 18:
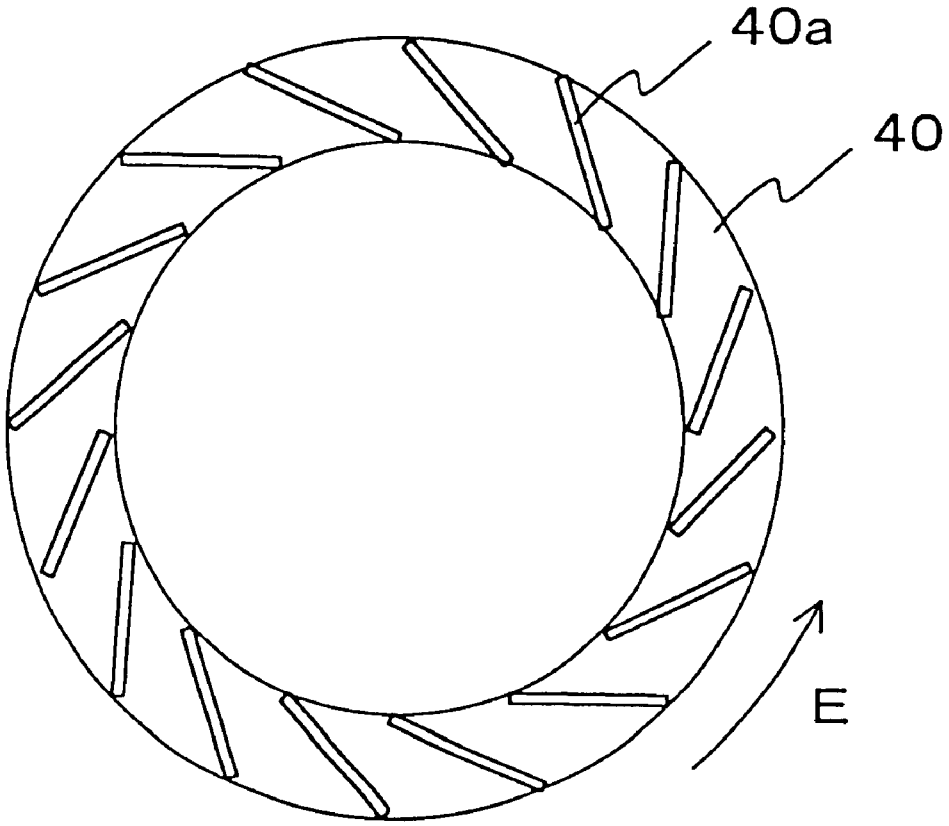
FIG. 18 is a plan view of the deflector ring of the flash drying apparatus of the second embodiment of the invention.

Moreover, on the disk 32, a plurality of hammers 82 having a shape as shown in FIG. 16, as seen on a plan view, are arranged in a circle, with their tips 82*a* pointing outward. Thus, this portion as a whole constitutes a crushing rotor 12. Above the crushing rotor 12, a taper ring 81 having increasingly smaller internal diameters downward is fixed to the inner wall of the liner 5*b*. It is preferable that the internal diameter of the taper ring 81 at the bottom end thereof be smaller than the diameter of the circle described by the inner ends of the hammers 82. Accordingly, the taper ring 81 is so formed that the inner edge thereof at the bottom end thereof, as seen in a plan view, is located at least inside the outer circumference of the hammers 82. Moreover, as shown in FIG. 18, on the top surface of the deflector ring 40, a plurality of blades 40*a* are provided, with the blades 40*a* each arranged with an inclination relative to the direction of the circumference of the deflector ring 40. In other respects, the flash drying apparatus of this embodiment is constructed in the same manner as that of the first embodiment shown in FIG. 4.

In this flash drying apparatus 25 constructed as described above, the raw material, in the form of clusters, fed in by the screw feeder 9*a* falls off the end surface 9*b* of the material feeder 9 onto the disk 32. As in the first embodiment, the outlet 9*b* protrudes so that the end surface 9*b*, as seen in a plan view, is located on the inside of the hammers 82. Thus, the raw material is, while being transferred to the outer circumference of the crushing rotor 12 by centrifugal force, dispersed and partially subjected to heat exchange. This helps restrain the deposition of the powdery or granular material on the inner wall (5*f* and 5*g*) of the enclosure 5 above the crushing rotor 12 and below the material feeder 9.

The bottom surface 81*a* of the taper ring 81 is located right above the hammers 82, and thus there is only a small surface area left on the inner wall of the enclosure 5 for the powdery or granular material to be deposited. This helps further restrain the deposition of the powdery or granular material, and, even if it is deposited, the bottom surface 81*a* restrains the growth of the deposition. Thus, it is possible to prevent an increase in pressure loss and prevent clogging of the enclosure 5.

Figure 17:
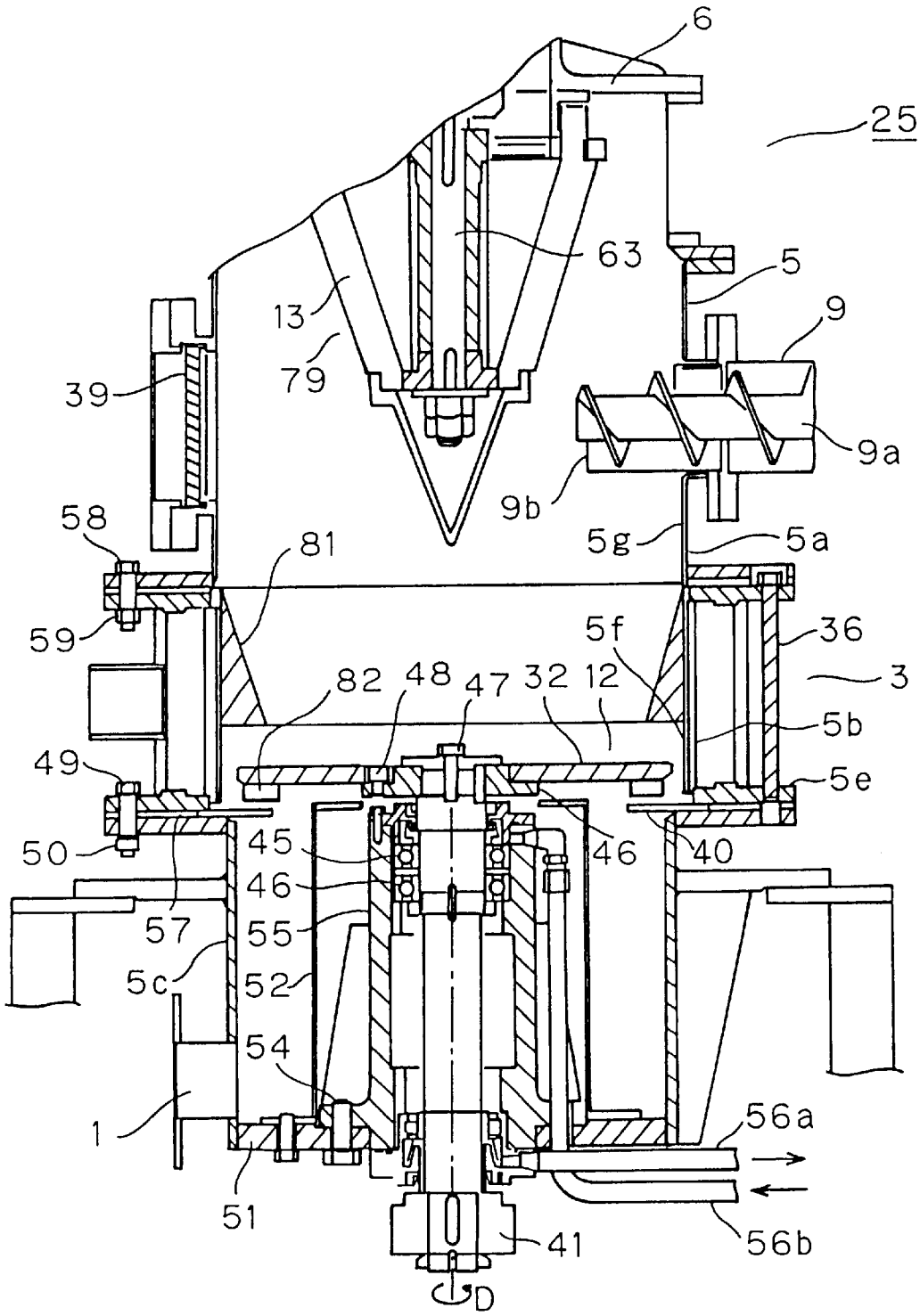
FIG. 17 is a sectional view of the flash drying apparatus of the second embodiment of the invention, with the hammers fitted in a different position.

The hammers 82 are fixed on the disk 32 with bolts (not shown) so that they can be removed and re-fixed on the bottom surface of the disk 32 as shown in FIG. 17. In this state, the raw material does not collide with the hammers 82 and thus is not crushed; that is, the raw material is only dispersed by the vortex air stream produced by the rotation of the hammers 82.

TABLE 1

| Hammer Position | Moisture Content % W.B. | Average Particle Diameter |
|---|---|---|
| Top Surface | 0.09 | 38 |
| Bottom Surface | 0.08 | 63 |

Table 1 lists the average particle diameter obtained when calcium carbonate originally having an average particle diameter of 78 $\mu$m and containing 20% of moisture was dried until it had a given moisture content with the hammers 82 fitted on the top or bottom surface of the disk 32. This table shows that, after drying, an average particle diameter of 38 $\mu$m was obtained with the hammers 82 fitted on the top surface of the disk 32 as shown in FIG. 15, and an average particle diameter of 63 $\mu$m was obtained with the hammers 82 fitted on the bottom surface of the disk 32 as shown in FIG. 17. Thus, with the hammers 82 fitted on the bottom surface, it is possible to obtain a powdery or granular material having a larger particle diameter from the same raw material.

If the powdery or granular material falls off the deflector ring 40 through the gap between the rotor 12 and the liner 5*b* and is deposited on the bottom plate 51, there is a risk of the powdery or granular material being ignited by the heat of the hot wind. To prevent this, the hot wind supplied from below is made to flow over the deflector ring 40 at a wind velocity of 30 m/s so as to blow the powdery or granular material upward to above the rotor 12.

Then, as the rotor 12 rotates, it produces a vortex air stream flowing in the direction indicated by arrow E in FIG. 18 over the deflector ring 40. This vortex air stream is turned by the blades 40*a* into an air stream flowing toward the outer circumference, and thus the powdery or granular material on the deflector ring 40 is transferred toward the outer circumference and is thereby prevented from falling.

In conventional constructions, a powdery or granular material having a particle diameter as large as 1 mm is prone to fall at a wind velocity of about 30 m/s and, to prevent this, it is necessary to increase the wind velocity, which is inevitably accompanied by an increase in pressure loss. By contrast, in this embodiment, it is possible to keep the powdery or granular material on the deflector ring 40 easily without an increase in pressure loss. The powdery or granular material is then made to collide with the blades 40*a* and is blown upward to above the rotor 12 by the hot wind.

Also in the first embodiment, the reflector ring 40 may be provided with blades 40*a*.

Figure 19:
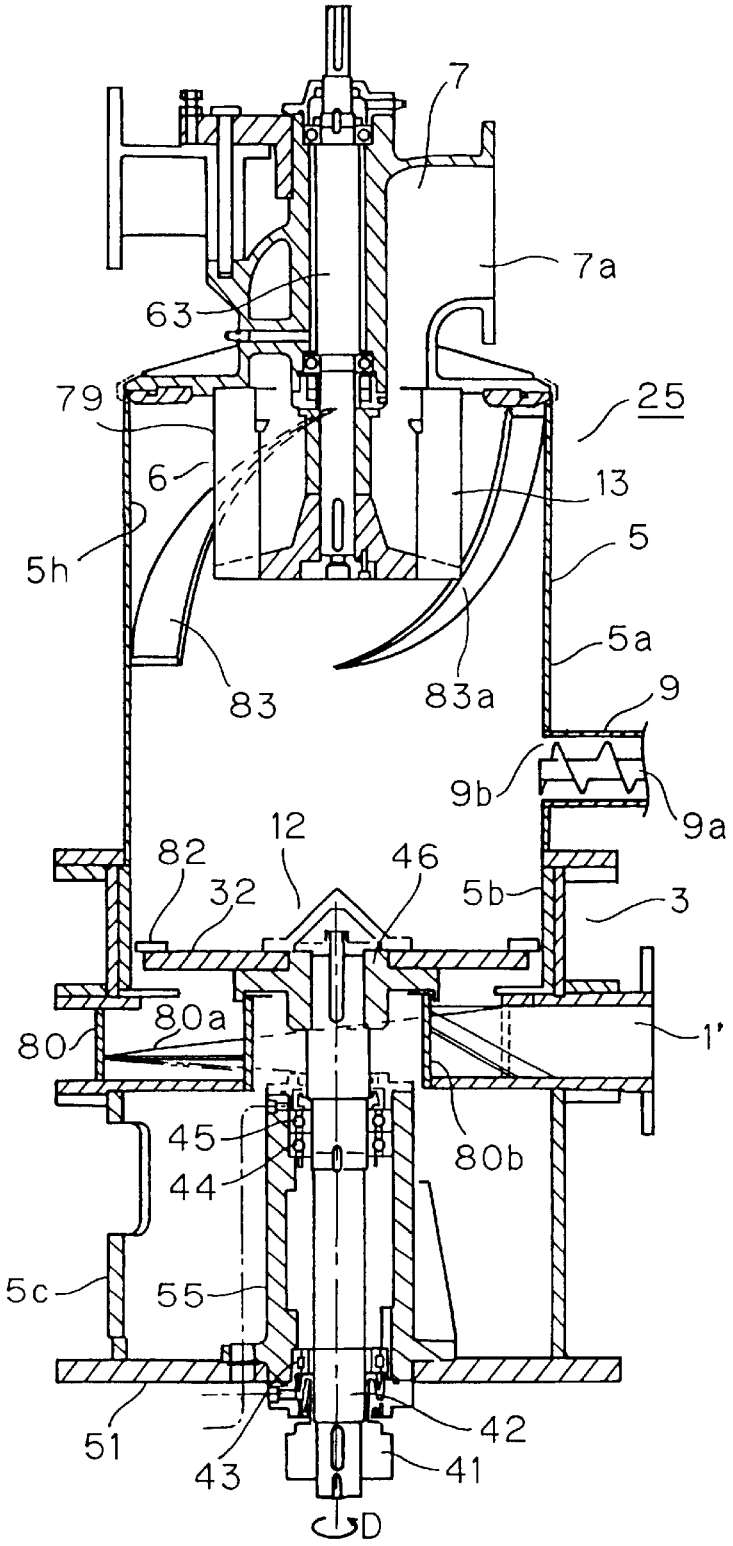
FIG. 19 is a sectional view of the flash drying apparatus of a third embodiment of the invention.

Next, FIG. 19 is a sectional view of the flash drying apparatus 25 of a third embodiment of the invention. Here, such elements as are found also in the first embodiment shown in FIG. 4 are identified with the same reference numerals. In this embodiment, a hot wind introducer 80 is provided between the liner 5*b* and the lower casing 5*c*.

On the inner wall of the upper casing 5*a*, a plurality of protruding pieces 83 having a helical shape are provided so as to face the classifier 6 that is constructed in the same manner as in the first embodiment. On the other hand, the crushing rotor 12 is constructed in the same manner as in the second embodiment, and has hammers 82. In other respects, the flash drying apparatus of this embodiment is constructed in the same manner as that of the first embodiment.

Figure 20:
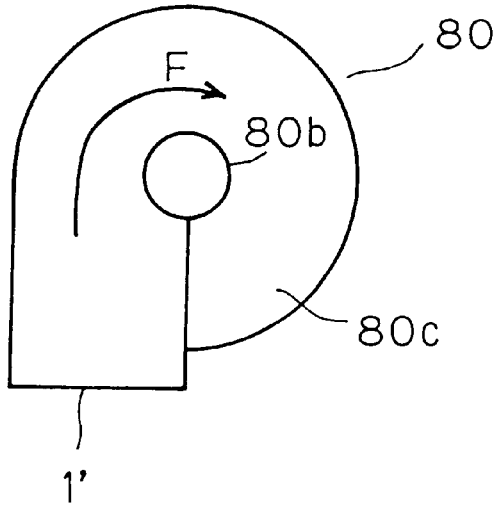
FIG. 20 is a plan view of the hot wind inlet portion of the flash drying apparatus of the third embodiment of the invention.

The hot air introducer 80 is provided with an inlet 1' through which it takes in a hot wind supplied from the hot wind generating apparatus 24 (see FIG. 3). A plan view of the hot air introducer 80 is shown in FIG. 20. As shown in this figure, the hot air introducer 80 has the inlet 1' provided in a decentered position, and has a hot wind passage 80*c* formed around an inner cylinder 80*b*. The bottom surface 80*c* of the hot air passage 80*c* is so formed as to be increasingly high so as to form a helix along the direction F in which the hot wind advances.

In the flash drying apparatus of the first embodiment shown in FIG. 4 described earlier, the raw material that has fallen down through the gap between the disk 32 and the liner 5*b* is deposited on the bottom plate 51. The bottom plate 51 becomes hot by being heated by the hot wind introduced through the inlet 1, and this causes scorching of the raw material deposited on the bottom plate 51.

By contrast, in this embodiment, where the hot wind passage 80*c* is provided, the raw material that has fallen through the gap between the disk 32 and the liner 5*b* into the hot air introducer 80 can be brought back upward by the hot wind. This helps prevent the deposition of the raw material on the bottom surface 80*a* of the hot wind passage 80*c* and thereby prevent scorching thereof.

Figure 21:
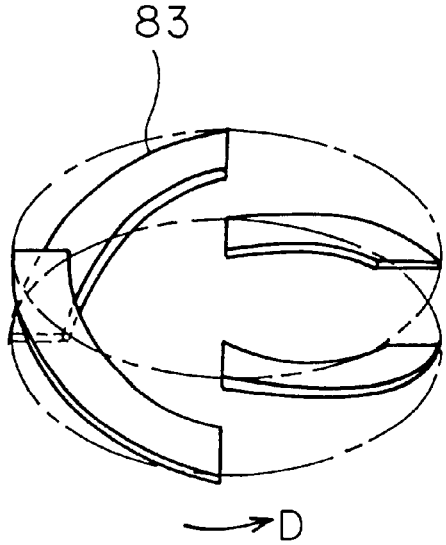
FIG. 21 is a schematic perspective view of the protruding pieces of the flash drying apparatus of the third embodiment of the invention.

A schematic perspective view of the protruding pieces 83 is shown in FIG. 21. As shown in this figure, the protruding pieces 83 are made of four thin plates that are arranged so as to incline downward relative to the direction of rotation (the direction indicated by D) of the crushing rotor 12. The raw material, originally in the shape of clusters, that has fallen onto the crushing rotor 12 is crushed and dispersed by the hammers 82, and is then further dispersed by the vortex air stream produced by the rotation of the crushing rotor 12.

The force of this vortex air stream is eventually attenuated as a result of the vortex air stream colliding with the bottom surfaces 83*a* of the protruding pieces 83. This helps reduce the centrifugal force acting upon the powdery or granular material, and thereby reduce the deposition of the powdery or granular material on that portion of the inner wall 5*f* of the enclosure 5 that faces the classifying rotor 79 and simultaneously ease the entry of the powdery or granular material into the classifier 6 disposed substantially at the center of the enclosure 5.

The force of the vortex air stream can be attenuated even if the protruding. pieces 83 are arranged parallel to center lines of the enclosure 5. However, arranging the protruding pieces 83 with an inclination and in the form of a helix is preferable, because then the powdery or granular material deposited on those surfaces 83*a* of the protruding pieces 83 with which the vortex air stream collides can more easily be blown off by the hot wind so as to fall downward. There may be provided any number of protruding pieces 83 than specifically given above.

Figure 22:
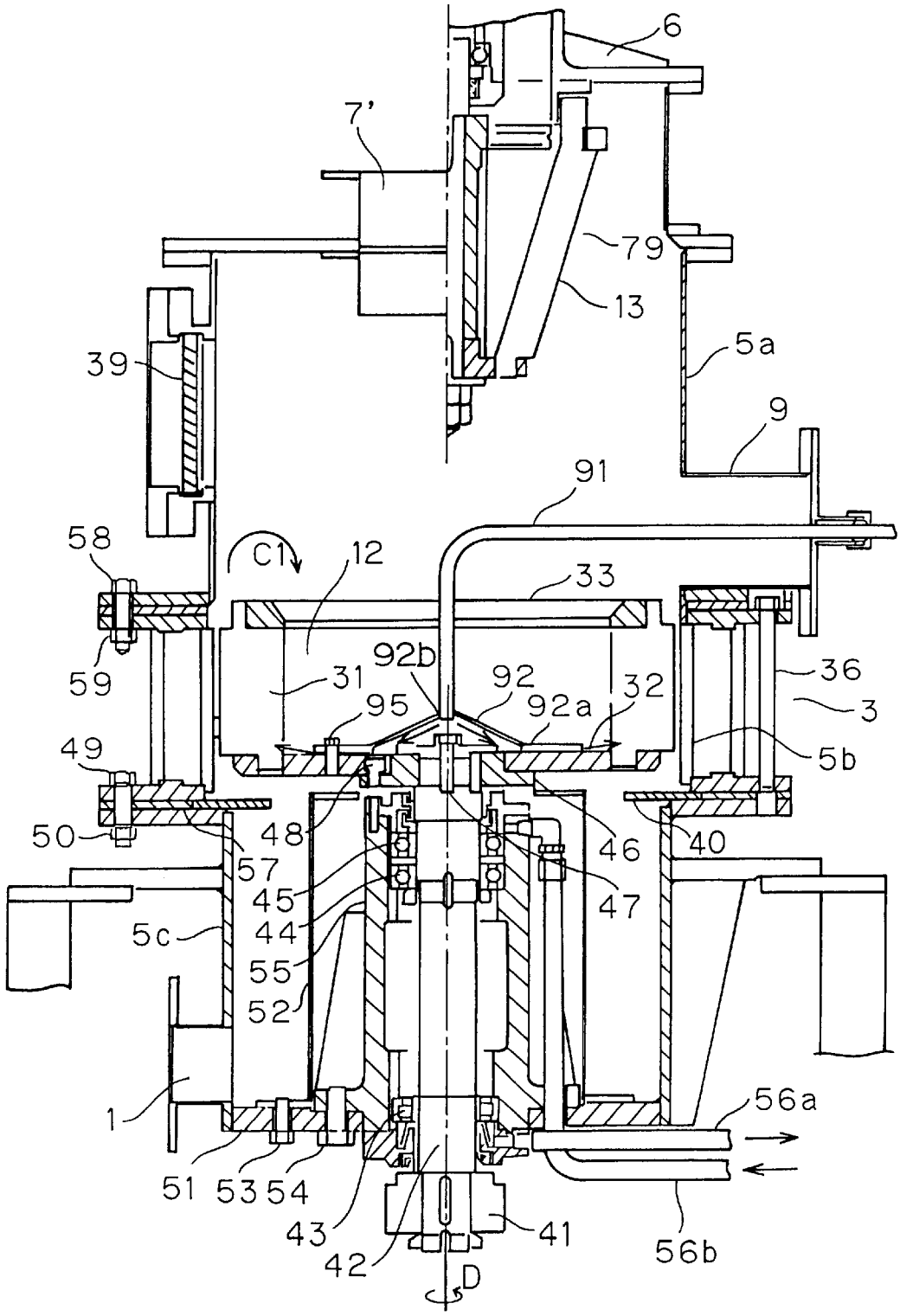
FIG. 22 is a sectional view of the flash drying apparatus of a fourth embodiment of the invention.

Next, FIG. 22 is a sectional view of the flash drying apparatus 25 of a fourth embodiment of the invention. Here, such elements as are found also in the first embodiment shown in FIG. 4 are identified with the same reference numerals. In this embodiment, the material feeder 9 is provided with a pipe 91, and the crushing rotor 12 has a disk 92 fixed thereto with bolts 95. This disk 92 has an opening 92*b* into which the pipe 92 is inserted. The disk 92 has a part thereof formed into a flat portion 92*a*, which is held above the disk 32 with washers (not shown) or the like placed in between so as to secure a predetermined gap there.

Figure 23:
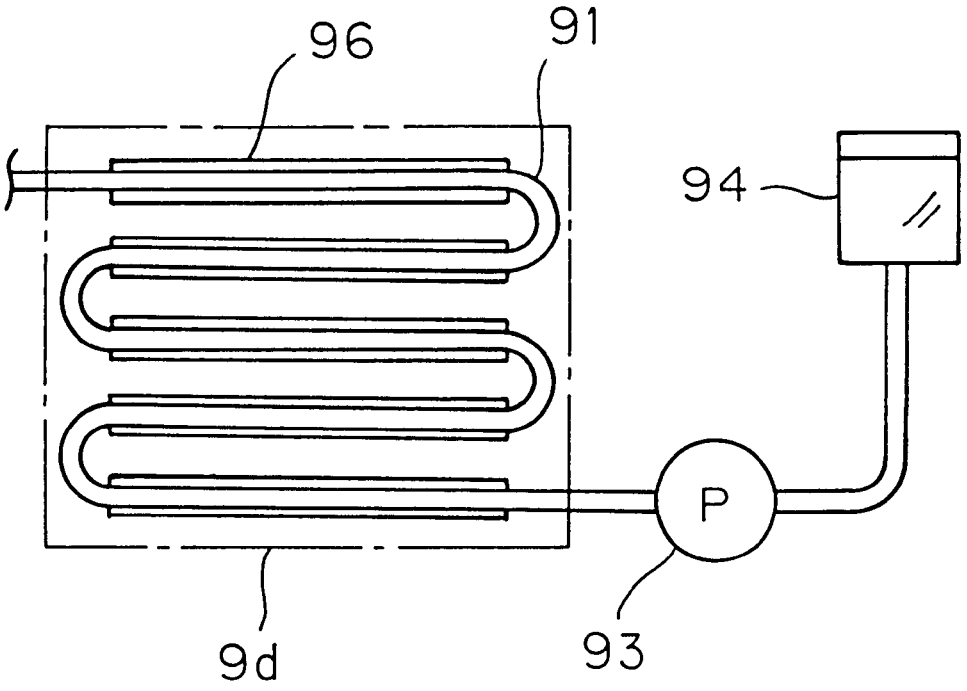
FIG. 23 is a diagram showing the material heater of the flash drying apparatus of the fourth embodiment of the invention.

The material feeder 9 has a heater 9*d*, as shown in FIG. 23, for heating the raw material inside the pipe 91. Inside the heater 9*d*, the pipe 91 is covered with jackets 96 having heating elements (not shown) embedded therein. A raw material in the form of slurry or liquid, i.e. a mixture of a powdery or granular material with water, is stored in a material tank 94, and is then fed therefrom through the heater 9*d* into the enclosure 5 by a feeding pump 93.

The classifier 6 provided above the enclosure 5 is constructed in the same manner as in the second embodiment shown in FIG. 15. The classifier 6 can be removed from the upper casing 5*a* and exchanged with an exhaust duct 7'. This permits the powdery or granular material to be exhausted without using the classifying rotor 79. Even in this case, by appropriately setting the internal diameter of the exhaust duct 7' and the amount by which it protrudes into the upper casing 5*a*, it is possible to classify the powdery or granular material. In other respects, the flash drying apparatus of this embodiment is constructed in the same manner as in the first embodiment.

In this flash drying apparatus 25 constructed as described above, the raw material, in the form of slurry or liquid, i.e. a mixture of a powdery or granular material with a large amount of water, is fed through the pipe 91 by the feeding pump 93, and is meanwhile heated by the heating elements so that its water content is evaporated. This increases the flow speed of the raw material inside the pipe 91 and thereby disturbs its flow, which promotes heat transfer and thus promotes evaporation of the water content.

Then, the raw material, now including both water and water vapor, is fed into the enclosure 5, and flows downward through the pipe 91 so as to be fed through the opening 92*b* onto the disk 32. The raw material, by its own surface tension, spreads and fills the gap between the disk 92 and the disk 32, and is thereby dispersed toward the outer circumference of the disk 32 over the entire surface thereof.

Thereafter, the raw material is dispersed by the rotating blades 31 into fine droplets, and is subjected to heat exchange with the hot wind. Moreover, as in the first embodiment, the raw material is dried repeatedly by the suction force acting as indicated by arrow C1. This makes it possible to dry fully even a raw material in the form of slurry or liquid. Although with lower drying efficiency, it is also possible to feed the raw material unheated, i.e. without providing the heater 9*d* in the material feeder 9, into the enclosure by driving the feeding pump 93.

As described in detail heretofore in connection with some embodiments, according to the present invention, the blades are made of thin plates, and are supported by being coupled to the ring-shaped member. This helps reduce the amount of raw material that falls onto the blades and is deposited thereon, and thereby restrain the growth of the deposit on the inner wall of the enclosure. Moreover, an air stream passage is formed that permits the air above the crusher to flow from the inside to the outside through the gaps between the blades. This permits the powdery or granular material to be dried repeatedly, and thus permits the raw material to be dried more fully.

Moreover, the ring-shaped member prevents the blades from being inclined by centrifugal force, and thus permits the blades to be made higher. This helps increase the length of time for which the raw material is crushed while being exposed to the hot wind. Thus, it is possible to disperse the powdery or granular material more fully than ever immediately after the crushing thereof, and thereby further restrain the deposition of the powdery or granular material on the inner wall of the enclosure above the blades.

Moreover, the projections formed on the outer-circumferential-end surfaces of the blades make it possible to scrape off the powdery or granular material deposited in the gap between the blades and the enclosure. In addition, it is possible to reduce the fluctuation of the load on the driving motor that drives the blades to rotate. This makes it possible to use a driving motor with a comparatively low maximum output and thereby reduce the manufacturing cost of the flash drying apparatus.

Moreover, the projections are provided at heights varying along the circumference, and this makes it possible to scrape off the powdery or granular material over the entire height of the enclosure. In addition, the powdery or granular material thus scraped off by the projections is blown upward by the hot wind supplied from below, and, in accordance with the type of the raw material, can be made to collide with the projections that move as the blades rotate. This helps limit the upward flow of the powdery or granular material and thereby stagnate it so as to achieve fuller dispersion thereof.

Moreover, the material feeder protrudes into the enclosure so as to permit the raw material in the form of clusters to fall onto the area on the inside of the blades. This permits the raw material to be dispersed and crushed while being transferred toward the outer circumference, and thus helps restrain the deposition of the powdery or granular material on the inner surface of the enclosure above the blades.

Moreover, the material feeder protrudes into the enclosure so as to permit the raw material in the form of clusters to fall onto the area inside the outer circumferential surface of the crushing member. This permits the raw material to be dispersed and crushed while being transferred toward the outer circumference, and thus helps restrain the deposition of the raw material that falls along the inner wall of the enclosure above the crushing member.

Moreover, the taper ring provided on the inner wall of the enclosure above the crusher so as to have increasingly smaller internal diameters downward permits the vertex air stream produced by the rotation of the crushing member to collide with the bottom surface of the taper ring and thus serves to attenuate the force of the vortex air stream. This helps reduce the centrifugal force acting upon the powdery or granular material, and thereby reduce the deposition of the powdery or granular material on that portion of the inner wall of the enclosure that faces the classifying rotor and simultaneously ease the entry of the powdery or granular material into the classifier disposed substantially at the center of the enclosure. In addition, the powdery or granular material deposited on those surfaces of the protruding pieces with which the vortex air stream collides can more easily be blown off by the hot wind so as to fall downward.

Moreover, the disk disposed over the plate-shaped member with a gap secured in between permits the raw material in the form of slurry or liquid to flow through a central portion of the disk into the gap. As a result, the raw material, by its own surface tension, spreads and fills the gap between the disk and the plate-shaped member, and is thereby dispersed toward the outer circumference of the plate-shaped member over the entire surface thereof. This makes it possible to dry fully even a raw material in the form of slurry or liquid.

The scraper that rotates integrally with the classifying blades makes it possible to scrape off the powdery or granular material deposited on the inner wall of the exhauster and thereby prevent clogging of the exhauster.

Moreover, the taper ring is so disposed that its bottom surface is located right above the crushing member. Thus, there is only a small surface area left on the inner wall of the enclosure for the powdery or granular material to be deposited. This helps restrain the deposition of the powdery or granular material above the crushing member, and, even if it is deposited, the bottom surface restrains the growth of the deposition. Thus, it is possible to prevent an increase in pressure loss and prevent clogging of the enclosure.

Moreover, the hot wind passage having the shape of a helix permits the raw material that has fallen through the gap between the enclosure and the plate-shaped member into the hot wind passage to be brought back upward by the hot wind. This helps prevent the deposition of the raw material in the hot wind passage and thereby prevent scorching of the raw material.

The air stream generating member disposed on the bottom surface of the plate-shaped member prevents the raw material from colliding with the air stream generating member and thus prevents the raw material from being crushed. Thus, the raw material is only dispersed by the vortex air stream produced by the rotation of the air stream generating member. This makes it possible to obtain, from the raw material supplied, dry powder or granules having a comparatively large particle diameter as desired.

What is claimed is:

1. A flash drying apparatus for drying a material containing moisture, comprising:

a cylindrical enclosure arranged vertically;

a crusher disposed in a lower portion of the enclosure for crushing the raw material into a powdery or granular material;

a material feeder for feeding the raw material to the crusher by letting the raw material fall onto the crusher;

a hot wind feeder for feeding a hot wind to the powdery or granular material from under the crusher;

a classifier for classifying the powdery or granular material blown upward inside the enclosure by the hot wind; and an exhauster for exhausting the classified powdery or granular material through an upper portion of the enclosure, wherein the crusher includes a rotating plate-shaped member, a plurality of blades made of thin plates and arranged radially on the plate-shaped member, and a ring-shaped member provided substantially parallel to the plate-shaped member for coupling the blades.

2. A flash drying apparatus as claimed in claim 1, wherein the blades have projections formed at end surfaces thereof facing an inner wall of the enclosure.

3. A flash drying apparatus as claimed in claim 2, wherein more than one of the blades have projections formed at end surfaces thereof facing an inner wall of the enclosure, the projections being formed at heights gradually varying along a circumference.

4. A flash drying apparatus as claimed in claim 1, wherein the material feeder has a screw feeder that moves forward the raw material by being rotated, and the material feeder protrudes inward from an inner wall of the enclosure so that an outlet of the material feeder is located inside the blades.

5. A flash drying apparatus as claimed in claim 1, wherein a deflector ring is provided below a gap between the plate-shaped member and the enclosure so as to face the plate-shaped member, and a plurality of anti-falling blades for preventing the powdery or granular material from falling off through the gap are arranged radially on the deflector ring, with each anti-falling blade given a predetermined inclination relative to a direction of a radius.

6. A flash drying apparatus for drying a material containing moisture, comprising:

a cylindrical enclosure arranged vertically;

a crusher, including a rotating plate-shaped member and a crushing member provided integrally therewith, for crushing the raw material into a powdery or granular material, the crusher being disposed in a lower portion of the enclosure;

a material feeder for feeding the raw material to the crusher by letting the raw material fall onto the crusher;

a hot wind feeder for feeding a hot wind to the powdery or granular material from under the crusher;

a classifier for classifying the powdery or granular material blown upward inside the enclosure by the hot wind;

a protruding piece arranged on a portion of an inner wall of the cylindrical enclosure facing the classifier so as to incline downward along a rotation direction of the plate-shaped member; and an exhauster for exhausting the classified powdery or granular material through an upper portion of enclosure.

7. A flash drying apparatus as claimed in claim 6, wherein the material feeder has a disk disposed parallel to the plate-shaped member with a slight gap secured in between, and the raw material is, in a form of slurry or liquid, introduced through a pipe-shaped member so as to flow onto a central portion of the disk and fed into the gap.

8. A flash drying apparatus as claimed in claim 6, wherein a taper ring having increasingly smaller internal diameters downward is provided between the crushing member and the material feeder.

9. A flash drying apparatus for drying a material containing moisture, comprising:

a cylindrical enclosure arranged vertically;

a crusher, including a rotating plate-shaped member and a crushing member provided integrally therewith, for crushing the raw material into a powdery or granular material, the crusher being disposed in a lower portion of the enclosure;

a material feeder for feeding the raw material to the crusher by letting the raw material fall onto the crusher;

a hot wind feeder for feeding a hot wind to the powdery or granular material from under the crusher;

a classifier for classifying the powdery or granular material blown upward inside the enclosure by the hot wind; and an exhauster for exhausting the classified powdery or granular material through an upper portion of the enclosure, wherein, in a portion of an inner wall of the enclosure above the crusher, a taper means is provided having increasingly smaller internal diameters downward.

10. A flash drying apparatus as claimed in claimed in claim 9, wherein the material feeder has a disk disposed parallel to the plate-shaped member with a slight gap secured in between, and the raw material is, in a form of slurry or liquid, introduced through a pipe-shaped member so as to flow onto a central portion of the disk and fed into the gap.

11. A flash drying apparatus as claimed in claim 9, wherein a taper ring having increasingly smaller internal diameters downward is provided between the crushing member and the material feeder.

12. A flash drying apparatus as claimed in claim 9, wherein the hot wind feeder has a helical hot wind passage through which the hot wind introduced through an inlet provided in a decentered position flows upward in a form of a vortex air stream.

13. A flash drying apparatus for drying a material containing moisture, comprising:

a vertical, cylindrical enclosure;

an air stream generator, composed of a rotating plate-shaped member and an air stream generating member provided so as to protrude downward from a bottom surface of the plate-shaped member and not upward above the plate-shaped member, for generating a vortex air stream, the air stream generator being disposed in a lower portion of the enclosure;

a material feeder for feeding a raw material onto the plate-shaped member;

a hot wind feeder for feeding a hot wind into a gap between the plate-shaped member and an inner wall of the enclosure from below;

a classifier for classifying a powdery or granular material blown upward inside the enclosure by the hot wind; and an exhauster for exhausting the classified powdery or granular material through an upper portion of enclosure.

* * * * *